United States Patent [19]

Jenkins et al.

[11] 4,439,083

[45] Mar. 27, 1984

[54] AUTOMATIC SHEET DISPENSING APPARATUS

[75] Inventors: Stuart M. Jenkins, Bognor Regis; Steven M. Hosking, Southsea, both of England

[73] Assignee: De La Rue Systems Limited, London, England

[21] Appl. No.: 385,401

[22] PCT Filed: Oct. 8, 1981

[86] PCT No.: PCT/GB81/00219

§ 371 Date: May 28, 1982

§ 102(e) Date: May 28, 1982

[87] PCT Pub. No.: WO82/01435

PCT Pub. Date: Apr. 29, 1982

[30] Foreign Application Priority Data

Oct. 10, 1980 [GB] United Kingdom ..... 8032881

[51] Int. Cl.[3] ..... B65H 33/00; B65H 31/30

[52] U.S. Cl. ..... 414/46; 271/187; 271/315; 414/48; 414/81

[58] Field of Search ..... 414/36, 46, 52, 45, 414/48, 49, 81, 35, 43; 271/178, 187, 315

[56] References Cited

U.S. PATENT DOCUMENTS

| | | | |
|---|---|---|---|
| 3,381,829 | 5/1968 | Turner | 414/81 |
| 3,451,562 | 6/1969 | Sjostrom | 414/35 |
| 3,532,230 | 10/1970 | Gutberlet et al. | 414/35 X |
| 3,772,972 | 11/1973 | Dutro et al. | 414/35 |
| 4,120,491 | 10/1978 | Lang | 271/178 X |
| 4,245,940 | 1/1981 | Luther et al. | 414/95 |

FOREIGN PATENT DOCUMENTS

| | | | |
|---|---|---|---|
| 196294 | 5/1965 | Sweden | 414/43 |

*Primary Examiner*—Robert J. Spar
*Assistant Examiner*—Janice Krizek
*Attorney, Agent, or Firm*—Sughrue, Mion, Zinn, Macpeak and Seas

[57] ABSTRACT

Automatic banknote dispensing apparatus is disclosed which comprises a stacker wheel (5) for feeding banknotes to form a stack (4), and a dispensing module for conveying the stack to a selected one of two presentation positions (not shown). The dispensing module comprises an elongated base plate (1) at 15° to the horizontal, a support plate (2) along one side of the base plate and against which the stack is formed, a movable pusher plate (9) disposed adjacent to and at right angles to the base plate and to the side support plate and mounted (at 10) to traverse in the direction of the length of the base plate, and means for driving the pusher plate between two positions intermediate the ends of the base plate. The stacker wheel delivers a stack of banknotes onto a central portion of the base plate (1) lying between the said two positions of the pusher plate. This central portion is preferably pivotable downwardly (about 20) to provide a "dump" facility. Vent holes (7) through the side support plate (2) allow air to escape during the formation of the stack.

9 Claims, 2 Drawing Figures

AUTOMATIC SHEET DISPENSING APPARATUS

BACKGROUND OF THE INVENTION

This invention relates to a dispensing module with a positive presentation of for example bank notes, for an automatic cash dispensing apparatus.

In existing automatic cash dispensing apparatus as described for example in European Patent Application No. 34502, the apparatus is built up from one or more feed modules and a dispensing module, the feed modules feeding bank notes of different denominations along a flowline to the dispensing module. In one such arrangement the dispensed bank notes are stacked by a stacker wheel on a transversely arranged flat belt which serves to transport the stack of notes to a left hand or a right hand presentation position.

Difficulties arise with this existing arrangement when the falling bank notes generate an air cushion which causes the notes to be stacked untidily, often resulting in notes being left on the transport belt after completion of the dispensing cycle.

An aim of the present invention is to overcome these difficulties.

SUMMARY OF THE INVENTION

According to the present invention there is provided an automatic sheet dispensing apparatus comprising means for feeding sheets to form a stack, and a dispensing module for conveying the stack to a selected one of two presentation positions, characterised in that the dispensing module comprises an elongated base plate, a support plate along one side of the base plate, in a plane at right angles to the base plate, a movable pusher plate disposed adjacent to and at right angles to the base plate and to the side support plate and mounted to traverse in the direction of the length of the base plate, and means to drive the pusher plate between two positions intermediate the ends of the base plate; and in that the feeding means is arranged to deliver a stack of sheets onto a portion of the base plate lying between the said two positions.

The sides of the base plate are preferably horizontal, and the plane of the base plate preferably slopes downwards towards the side support plate. The slope should ideally be around 15° to the horizontal. In a preferred form, there is at least one straight longitudinal channel in the base plate, and at least one projection on the lower edge of the pusher plate which lies in a corresponding channel.

Preferably, the pusher plate is connected to a motor-driven endless belt passing around a drive pulley and an idler pulley mounted on a side mounting plate parallel to the side support plate.

Conveniently, the pusher plate is supported and guided by a slideway secured to the side mounting plate.

In the preferred construction the side support plate acts as a stripper to remove e.g. bank notes from a pair of stacker wheels. A plurality of holes are preferably formed in the side support plate below the stacker wheels to disperse air cushions caused by falling bank notes.

The centre of the base plate is conveniently formed with a downwardly pivotable section to provide a 'dump' facility to remove wrongly dispensed notes from the bank note dispensing path to a reject container.

BRIEF DESCRIPTION OF THE DRAWINGS

An embodiment of the invention will now be described, by way of example, with reference to the accompanying drawings in which.

DETAILED DESCRIPTION OF THE PREFERRED EMBODIMENT

Figure 1:
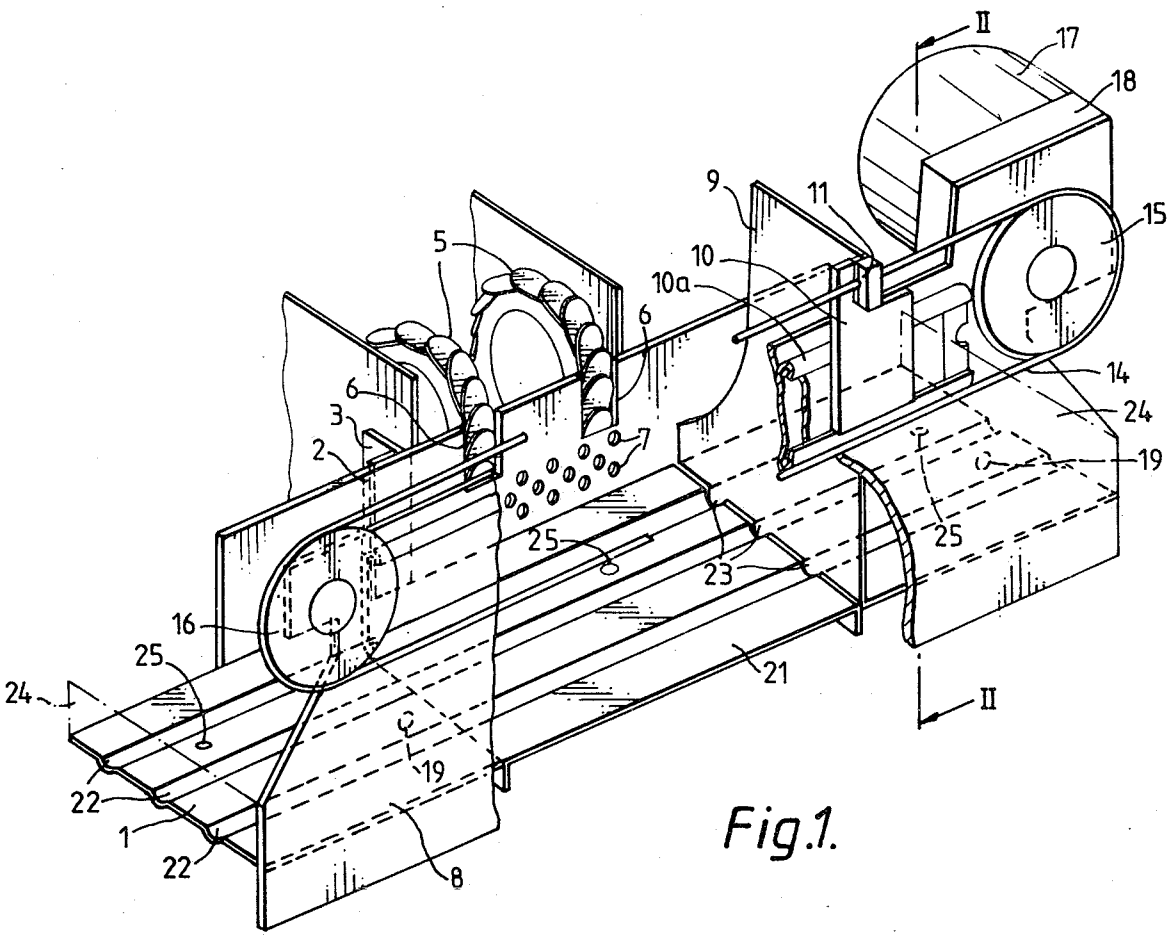
FIG. 1 is a perspective view of a dispensing drive mechanism of the dispensing module.

Referring now to the drawings in detail the dispensing drive mechanism comprises a base plate 1 with a side support plate 2 at right angles thereto. The base plate and side support plate are mounted by brackets 3 to the frame of the dispensing apparatus (not shown).

Figure 2:
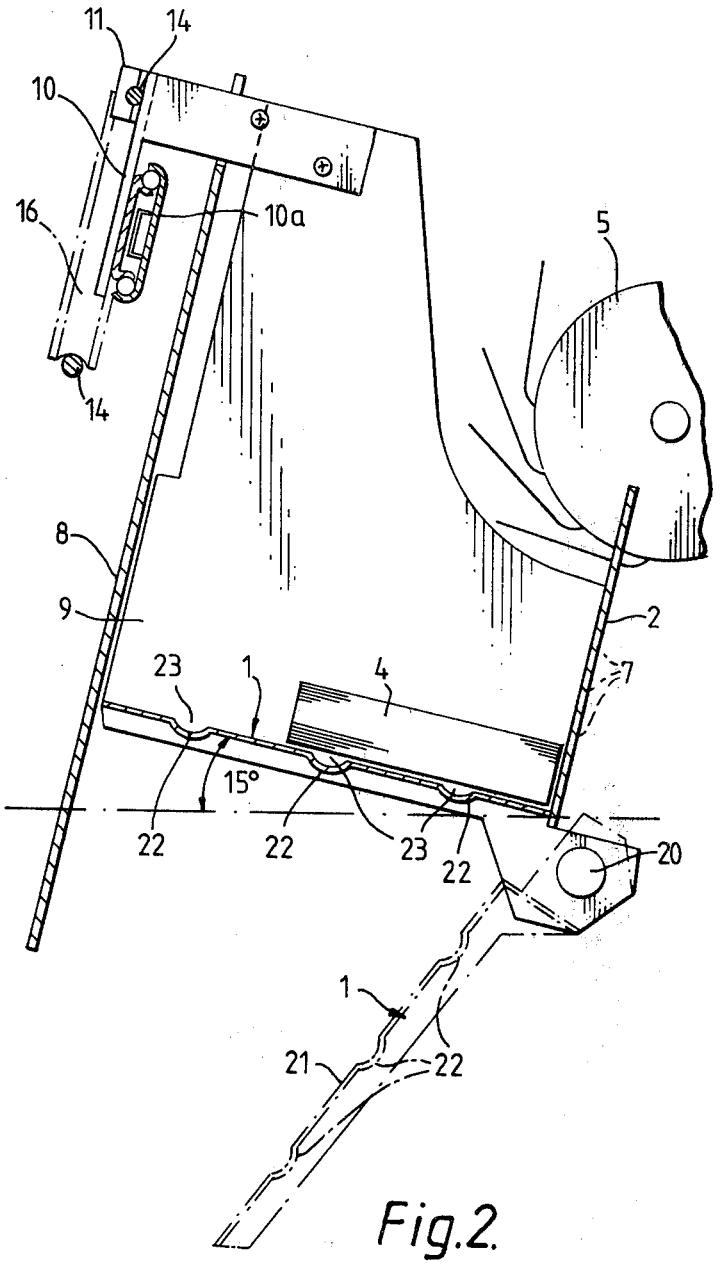
FIG. 2 is a cross-section taken along the line II—II of FIG. 1.

The base plate is located at an angle of 15° to the horizontal, as shown in FIG. 2, so that the base plate 1 and side support plate 2 form an angled support for aligning a stack of bank notes 4 fed from a pair of tined stacking wheels 5. These stacking wheels project through slots 6 in the side support plate which has a plurality of holes 7 arranged below the slots to allow the passage of air from the air cushion generated by the falling bank notes as they are stripped from the stacking wheels by the side support plate.

Parallel to the side support plate 2 is a mounting plate 8 on which a pusher plate 9 is reciprocatingly mounted to move longitudinally of the base plate 1. The pusher plate 9 is mounted at right angles to the base plate by a bracket 10 screwed to the inner member of a three member slideway **10*a* of the kind sold under the Trade Mark ACCURIDE, the outer member of the slideway being secured, by means not shown, to the mounting plate 8. The bracket 10 is clamped by a plate 11 to an endless belt 14 of circular cross-section made of a material known as POLYCORD. The belt 14 extends around two pulleys, a drive pulley 15 and an idler pulley 16, the drive pulley 15 being driven by an electric motor 17 via a gear box 18**.

The drive to the motor is microprocessor-controlled in response to two photo sensors 19 which are triggered by a flag carried by the bracket 10. The photo sensors 19 are located under the two extreme positions of the pusher plate.

The centre section of the base plate is hinged at 20, to the lower end of the side support plate, to pivot downwards and form a dump facility 21.

The base plate 1 is formed from sheet metal with three longitudinal parallel channels 22 which cooperate with three correspondingly shaped projections 23 on the lower edge of the pusher plate. These projections and channels reduce the risk of dispensed bank notes sliding under the pusher plate as it traverses the base plate to push a stack of dispensed notes to dispensing outlets 24 at the respective ends of the base plate.

Three optical sensors 25 positioned one at the centre and one near each dispensing outlet of the base plate, indicate whether any notes have been left after each dispense or after a "dumping" operation.

In operation, the automatic cash dispensing apparatus incorporating the positive note dispensing mechanism is controlled by bank tellers from, for example, two terminals (not shown) to dispense to the two dispensing outlets 24 respectively. A command to dispense a transaction in selected denominations of bank notes is sent from one of the terminals. The notes are delivered to the stacking wheels by known means, an example of which is described in U.K. Application No. 2,006,168, and then stripped from the stacking wheels and stacked in a neat pile on the angled base plate and moved by the pusher plate 9 to one of the dispensing oullets 24.

The pusher plate 9 is controlled by the photo sensors 19, one of which is actuated when the pusher plate is moved to a waiting position at the end of a dispensing operation ready for the next dispense. The waiting position is determined by which terminal issued the last dispense command. If the next dispense is from the same terminal as the previous one the pusher plate is returned to the opposite waiting position before the next dispensing cycle can commence.

The length of travel between the two waiting positions is 245 mm and the pusher plate is driven at a linear speed of 264 mm/sec. thus the pusher plate will move from one waiting position to the other in 0.9 seconds.

The passage of the stack of bank notes to either dispensing outlet is followed by the three optical sensors 26 located on the base plate 1 so that a check can be made through the microprocessor that all the notes have been transferred from the stacking position to the respective dispensing position. If any notes are left in the stacking position then the 'dumping' facility can be operated to tip the notes in that position into a reject container (not shown). The dumping facility can also be used in the event of an incorrect count, before the pusher plate is moved, to dump the wrongly-counted stack of bank notes.

Various modifications may be made to the invention, for example, the dispensing outlets can be provided with a shutter which grips the stack of notes and holds them secure until removed by the teller or customer.

We claim:

1. An automatic sheet dispensing apparatus, comprising: means for feeding sheets singly to form a stack, and a dispensing module for conveying the stack to a selected one of two presentation platforms, the dispensing module comprising an elongated base plate (1) defining the presentation platforms and inclined to the horizontal, an upwardly extending support plate (2) along a lower lateral edge of the base plate in a plane at right angles to the base plate, a movable pusher plate (9) disposed adjacent to and at right angles to the base plate and to the support plate and mounted (at 10) to traverse in the direction of the length of the base plate, and means (14 to 18) to drive the pusher plate between two positions intermediate the ends of the base plate, the feeding means being arranged (at 5) to deliver a stack of sheets (4) onto a receiving platform (21) of the base plate lying between the two presentation platforms with the sheets lying in superimposition parallel to the base plate, the dispensing apparatus characterized in that the base plate (1) has fixed end sections terminating in the presentation platforms and a downwardly pivotable middle section which constitutes the receiving platform (21) of the base plate to allow a faulty stack of sheets thereon to be dumped, and in that there is at least one straight continuous longitudinal channel (22) extending along all three platforms of the base plate and at least one projection (23) on a lower edge of the pusher plate which mates with and runs in said channel to reduce the risk of dispensed sheets sliding under the pusher plate as it traverses the base plate.

2. An apparatus according to claim 1, characterised in that the upper and lower edges of the base plate (1) are horizontally oriented, and the plane of the base plate slopes downwards towards the side support plate (2).

3. An apparatus according to claim 2, characterised in that the slope is between 10° and 20° to the horizontal.

4. An apparatus according to claim 3, characterised in that the slope is at about 15° to the horizontal.

5. An apparatus according to any of claims 1 to 4, characterised in that there are vent holes (7) through the support plate (2) in the region of the receiving platform.

6. An apparatus according to any of claims 1 to 4, wherein the pusher plate is connected to a motor-driven endless belt (14) passing around a drive pulley (15) and an idler pulley (16) mounted on a side mounting plate (8) parallel to the support plate.

7. An apparatus according to claim 6, wherein the pusher plate (9) is supported and guided by a slideway (10*a*) secured to the side mounting plate (8).

8. An apparatus according to any of claims 1 to 4, wherein the feeding means includes a pair of stacker wheels (5,5), so disposed that the support plate (2) acts as a stripper to remove sheets from the stacker wheels whereby the sheets fall towards the base plate and form the stack (at 4).

9. An apparatus according to claim 8, wherein the support plate has a pair of vertical slots (6) through which the stacker wheels project.

* * * * *